United States Patent [19]

Bradley et al.

[11] Patent Number: 4,468,071

[45] Date of Patent: Aug. 28, 1984

[54] DOUBLE LATCH SNAP LOCK BASE FOR ANNULAR FLUORESCENT LAMPS

[75] Inventors: Irving Bradley, Russell Township, Cuyahoga County; Gerald W. Povall, Highland Heights, both of Ohio

[73] Assignee: General Electric Company, Schenectady, N.Y.

[21] Appl. No.: 469,340

[22] Filed: Feb. 24, 1983

Related U.S. Application Data

[63] Continuation of Ser. No. 235,687, Feb. 18, 1981, abandoned.

[51] Int. Cl.[3] ..... H01R 33/08

[52] U.S. Cl. ..... 339/50 C

[58] Field of Search ..... 339/50 C, 145 D, 145 T

[56] References Cited

U.S. PATENT DOCUMENTS 2,626,977 1/1953 Hinman ..... 339/50 C 2,805,406 9/1957 Grovemiller et al. ..... 339/145 D 3,898,495 8/1975 Livera ..... 339/50 C 4,002,394 1/1977 Cordiano et al. ..... 339/50 C

*Primary Examiner*—Neil Abrams

*Attorney, Agent, or Firm*—John F. McDevitt; Philip L. Schlamp; Fred Jacob

[57] ABSTRACT

An improved plastic base for annular fluorescent lamps is disclosed having two semicylindrical parts which can be assembled together reliably in high speed manufacture to provide an assembled lamp less prone to failure during use. The first part includes double latch means together with locking pins and mates with a second part having means to receive these latching and locking elements when the parts are joined together. Other elements are also located on both parts to limit rotation of the assembled base about the annular lamp. Tapered conductive contact ends can also be used to facilitate high speed manufacture when inserted into tapered openings in the lamp base.

6 Claims, 3 Drawing Figures

Fig. 1
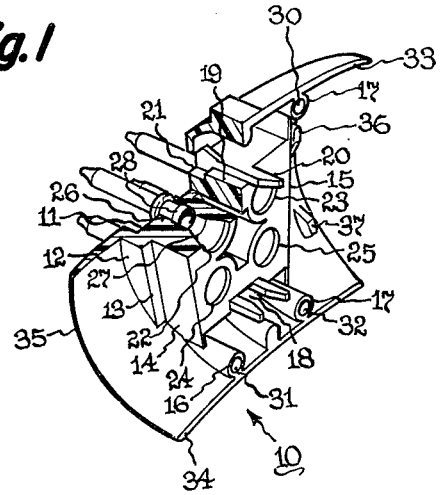
Fig. 2
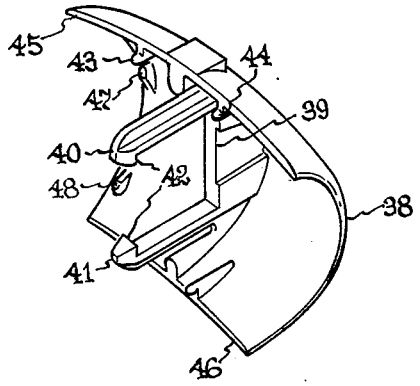
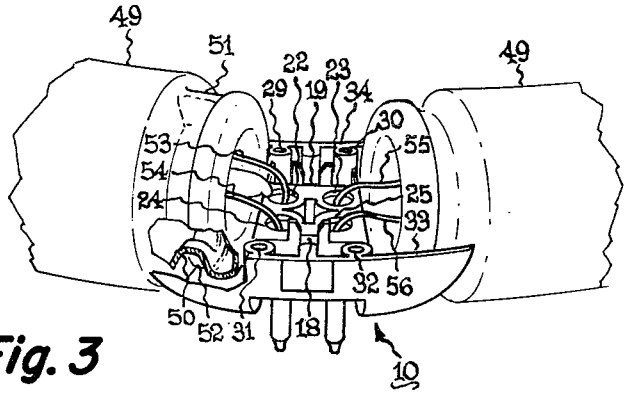
Fig. 3

DOUBLE LATCH SNAP LOCK BASE FOR ANNULAR FLUORESCENT LAMPS

This is a continuation, of application Ser. No. 235,687, filed Feb. 18, 1981 now abandoned.

BACKGROUND OF THE INVENTION

A single latch snap lock base for annular fluorescent lamps is disclosed in issued U.S. Pat. No. 4,002,394, which is assigned to the assignee of the present invention. Said prior art plastic base comprises two semicylindrical parts wherein a first part comprises a dowel and a latch pin extending from the interior thereof which mates with a second part having recesses for receiving the dowel and latch pin elements to secure the two parts in a fixed relationship. While a double latch pin construction for said base is said to be useful, it is said to increase the force necessary to attach the base halves together as well as make it more difficult to disassemble the base halves if repairs are to be made during lamp manufacture. A boss member is included in said prior art base construction which is formed in one of the mating parts for receiving lead-in wires extending from the assembled lamp and reinforcing means are provided on the interior of said mating parts in the form of semicircular discs orthogonal to the semicylindrical surfaces to help prevent flexure after the parts have been assembled together. Rotation of the assembled base about the annular lamp is limited by other leg elements which protrude inwardly from the semicylindrical outer wall in one of the mating parts to engage a metal tang or a glass nodule on the lamp glass envelope.

A number of significant problems have been experienced with said prior art base construction as the speed of lamp manufacture has increased as well as during subsequent lamp use. The torqueing forces normally encountered during lamp manufacture and assembly not only caused unlatching of the mating parts after assembly but produced mechanical failures when the single latch pin in the assembled base was forced against the channel into which the latch pin had been inserted. These normal torqueing forces during lamp manufacture further applied an excess torque load on the leg elements used to prevent base rotation after lamp assembly which also tended to force the base halves apart exposing the uninsulated lamp lead-in wires. Untapered conductive contact pins and openings in the prior art base construction also produced frequent misalignment or mis-feeding of lead-in wires which became even more severe as the speed of lamp manufacture increased.

It would be desirable to alleviate all of the foregoing problems with an improved lamp base construction which does not require a major design change and which is also less subject to mechanical failure during lamp manufacture. Likewise, it would be desirable in producing said benefits if the improved lamp construction resisted base unlatching during use to a greater degree in order to reduce any consequent exposure of the uninsulated lamp lead-in wires.

SUMMARY OF THE INVENTION

An improved double latch snap-lock base is herein provided for annular fluorescent lamps which includes redundancy of the rotation prevention means and additional locking means to help prevent opening up the mating parts after lamp assembly. Other structural modifications are provided in the improved lamp base to facilitate higher speed lamp manufacture with a modified lamp glass envelope including a circumferential recess located at one end of said envelope that is adapted for structural cooperation with the improved lamp base.

Briefly, said improved base for an annular lamp comprises a pair of mating parts each having a semicylindrical shape, said parts containing a pair of channel and leg elements having fitted cross sections formed on the interior thereof and spaced from the semicylindrical surfaces, both said leg elements comprising latching means and both of said channel elements receiving said leg elements for engaging said latching means so that physical clearances remain therebetween, a boss formed in the semicylindrical outer wall of one of said parts for receiving conductive contact pins, locking pins for insertion in recesses located on opposing contact surfaces of said mating parts to help prevent flexure and unlatching after assembly of said mating parts, reinforcing means on the interior of said parts and located at the middle portion thereof which cooperate with said locking pins to prevent flexure of the mating parts, said reinforcing means comprising semicircular discs and ribs orthogonal to the external surface and connecting said boss to the inner surface of said one part and attached to the interior of the other part, and lug elements located on both semicylindrical walls of said mating parts which grip a circumferential recess located at one end of the lamp to prevent rotation of the assembled base about said lamp. In a preferred embodiment, tapered conductive contact pins are employed for insertion into tapered openings provided in the boss element of one mating part and which openings further include larger diameter tapered entrances serving as guide means when the lead-in wires are inserted into the openings. In the preferred lamp construction, an annular glass envelope is provided having spaced apart sealed ends with a circumferential recess being located at one sealed end and which includes a pair of opposing protuberances disposed in said recess with the present improved base enclosing said ends and the space therebetween by gripping said circumferential recess and both protuberances therein to limit rotation.

BRIEF DESCRIPTION OF THE DRAWINGS

FIG. 1 is a perspective view of the contact pin half of the base;

FIG. 2 is a perspective view of the leg half of the base; and

FIG. 3 illustrates a partially assembled lamp in accordance with the present invention depicting the manner of engagement between the base and lamp envelope to limit rotation after assembly.

DESCRIPTION OF THE PREFERRED EMBODIMENTS

Referring to FIG. 1, the contact pin half of the base in accordance with the present invention comprises a semicylindrical outer shell 10 having a centrally located recess 11 formed in the convex side thereof, which forms a boss 12 in the interior thereof. Shoulder 13 is part of boss 12 and serves to limit the motion of the joined base pieces along a circular axis of the toroid formed by the assembled lamp. Shoulder 13 also adds material around recess 11 to strengthen the part. A pair of semicircular discs 14 and 15 are located at the middle portion of said mating part on each side of the boss member and extend in a direction orthogonal to the toroid axis and serve to provide additional mechanical reinforcement of the part against flexure. Further mechanical reinforcement is provided in said central region in the form of a pair of protuberances 16 extending forwardly from disc 14 and a second pair of protuberances 17 extending forwardly from disc 15 which include openings to receive locking pins located on the leg half of the base. A pair of channels 18 and 19 are also located in the boss 12 to receive a pair of leg elements described in connection with FIG. 2 which form the double latch mechanism of the present base construction. Each of said channels includes a shoulder 20 provided with a bevel to facilitate insertion of the pair of latching leg elements. At the end of each shoulder, an aperture 21 is formed through the semi-cylindrical outer wall of shell 10 and provide an access for releasing the latched leg elements in the event that it is desired to disassemble the lamp. In the present latching mechanism, the physical dimensions of the channel and leg elements are maintained to provide physical clearances between all mating surfaces which precludes any application of torsion after the base has been assembled forcing the base halves apart.

Four openings 22, 23, 24 and 25 are provided in the boss 12 to receive conductive contact pins for connection to the lamp lead-in wires. Each of said openings has a tapered construction which includes a tapered bore 26 matching the diameter of the conductive contact pin and larger diameter tapered bore 27 serving to guide entrance of the lead-in wires into the openings during lamp manufacture. The tapered conductive contact pins 28 employed in said embodiment reduce difficulties experienced with lead-in wire feeding during high speed lamp manufacture and can be formed with a hollow core to enable anchoring in the smaller tapered opening with a conventional flaring step.

Four recesses 29, 30, 31 and 32 are provided on opposing contact surface 33 and 34 of said mating part to receive locking pins which help prevent unlatching of the base assembly. Such locking means avoids flexure otherwise imparted to the latch mechanism when torsional forces are applied and forms part of the reinforcing means in the base assembly. The wall thickness 35 of both mating parts in the base assembly is of a relatively uniform thickness and produces a non-circular cross section when these parts are assembled together to form a toroidal segment. Lug elements 36 and 37 are also provided on the inner surface at one end of the pin half base shell to limit rotation of the assembled base about the annular lamp. Said lug elements engage a glass nodule located in a circumferential recess at one end of the annular lamp and a similar arrangement is provided in the leg half of the base shell to reduce the chance of base separation. The overall rotation limitation means thereby utilizes a pair of opposing lug elements for cooperation with like disposed nodules in the circumferential recess of the annular lamp glass envelope for a redundant mode of operation. Rotation limitation is to prevent breaking or shorting of lead-in wires, during lamp installation. Limited motion is desirable for installation.

FIG. 2 illustrates the double latch locking pin half of the base in accordance with the present invention. A semi-cylindrical outer shell 38 is provided being essentially symmetrical with the mating part already described. A semicircular reinforcing disc 39 protrudes outwardly therefrom which includes a pair of leg elements 40 and 41 each having a latching shoulder 42 for engagement in the channel openings of the previously described base half. Two pair of locking pins 43 and 44 protrude outwardly from opposing contact surfaces 45 and 46 of base shell 38 to prevent flexure as above explained. A pair of lug elements 47 and 48 disposed at one end of the interior base surface form part of the rotation prevention means as also previously explained.

While the base halves of the presently improved construction can be fabricated in a number of ways using a variety of insulating materials, it is preferred that a synthetic thermoplastic polymer be utilized and that the halves be injection molded, both of which are well-known per se in the art. A suitable thermoplastic is a phenylene oxide based resin such as sold under the trade name "Noryl SE1" by General Electric Company. Other plastics may also be utilized considering the cost, density, resilience and temperature stability of the plastic.

FIG. 3 illustrates a partially assembled lamp utilizing a base construction in accordance with the present invention. Accordingly, an annular all-glass type lamp envelope 49 is illustrated having spaced apart sealed ends with a circumferential recess 50 being located at one sealed end which includes a pair of opposing protuberances 51 and 52 disposed in said recess. The previously described pin base half 10 encloses both ends of the annular fluorescent lamp therebetween so that its lug elements (not shown) grip said circumferential recess and a rearwardly disposed glass nodule 52 in order to prevent rotation of said base part about the lamp. The leg half of the base also not shown in this drawing similarly engages in the lamp glass envelope when the base is assembled so that its lug elements will grip the opposing glass nodule 51 in said recess. Accordingly, the fully assembled rotation limitation means provided redundant physical cooperation to prevent the lamp lead-in wires from being stressed. Said lamp lead-in wires 53, 54, 55 and 56 are depicted as extending from both sealed ends of the lamp glass envelope and being inserted into contact pin openings 22, 23, 24 and 25, respectively, in the assembled lamp. Also depicted in said drawing for greater explanation are the channels 18 and 19 which engage leg elements in the remaining half of the base although apertures 21 which communicate with said channel elements cannot be seen. Finally, the contact surfaces 33 and 34 are shown together with the recess elements 29, 30, 31 and 32 which are located thereon.

It will be apparent from the foregoing description that an improved base construction for annular fluorescent lamps is provided which is significantly less prone to mechanical failure during manufacture and subsequent use of the assembled lamp. It will be apparent to those of ordinary skill in the art, however, that still further modifications can be made within the spirit and scope of the present invention. For example, additional physical clearances can be provided at the inner diameter of the mating parts in order to accommodate variation in the diameter of the lamp glass envelope. It is thereby intended to limit the invention, therefore only by the scope of the following claims.

What we claim as new and desire to secure by United States Letters Patent is:

1. An improved base for an annular lamp comprising:

(a) a pair of mating parts having a semicylindrical shape, said parts containing a pair of centrally located channel and leg elements having fitted cross sections formed on the interior thereof and spaced from the semicylindrical surfaces, (b) both of said leg elements comprising latching means and both of said channel elements receiving said leg elements for engaging said latching means so that physical clearances remain between all mating surfaces of said channel and leg elements producing an unstressed condition thereof after assembly together of said parts, each of said channels communicating through the semicylindrical wall in one of said mating parts to form apertures for disengaging both leg elements after assembly, (c) a boss formed in the semicylindrical outer wall of one of said parts and centrally located for receiving conductive contact pins and said leg elements, (d) four locking pins for insertion in recesses located on opposing contact surfaces of said mating parts which are located adjacent said boss and physically cooperate with said latching means to help prevent flexure and unlatching after assembly of said mating parts, (e) reinforcing means on the interior of said parts and located at the middle portion thereof which cooperate with said locking pins to prevent flexure of the mating parts, said reinforcing means comprising semicircular discs orthogonal to said semicylindrical surfaces and connecting said boss to the inner surface of said one part and attached to the interior of the other part, and (f) lug elements located at the ends of both semicylindrical walls of said mating parts which enter a circumferential recess located at one end of the lamp and further said lamp including a pair of glass nodules located in said recess to limit rotation of the assembled base about said lamp while still retaining said unstressed condition.

2. The base of claim 1 wherein the boss includes guide means facilitating insertion of lamp lead-in wires.

3. The base of claim 2 wherein said guide means comprise a tapered entrance aperture of larger diameter than said contact pins.

4. The base of claim 1 wherein the conductive contact pins are tapered for engagement with tapered openings in the boss.

5. An annular fluorescent lamp comprising:

(a) an annular glass envelope having spaced apart sealed ends with a circumferential recess located at one end which includes a pair of opposing protuberances in said recess, (b) a base enclosing said ends and the space therebetween which grips said circumferential recess and prevents rotation of the assembled base about said lamp, said base comprising:

(c) a pair of mating parts having a semicylindrical shape and relatively uniform wall thickness which form a toroidal segment when assembled with a non-circular cross section, said parts containing a pair of centrally located channel and leg elements having fitted cross sections formed on the interior thereof and spaced from the semicylindrical surfaces, (d) both of said leg elements comprising latching means and both of said channel elements receiving said leg elements for engaging said latching means so that physical clearances remain between all mating surfaces of said channel and leg elements producing an unstressed condition thereof after assembly together of said parts, each of said channels communicating through the semicylindrical wall in one of said mating parts to form apertures for disengaging both leg elements after assembly, (e) a boss formed in the semicylindrical outer wall of one of said parts at a central location having tapered apertures for receiving conductive contact pins and said leg elements, (f) four locking pins for insertion in recesses located on opposing contact surfaces of said mating parts which are located adjacent said boss and physically cooperate with said latching means to help prevent flexure and unlatching after assembly of said mating parts, (g) reinforcing means on the interior of said parts and located at the middle portion thereof which cooperate with said locking pins to prevent flexure of the mating parts, said reinforcing means comprising semicircular discs orthogonal to said semicylindrical surfaces and connecting said boss to the inner surface of said one part and attached to the interior of the other part, and, (h) lug elements located at the ends of both semicylindrical walls of said mating parts which enter said recess and are engageable with said protuberances to limit rotation of the assembled base about said lamp while still retaining said unstressed condition.

6. The lamp of claim 5 wherein the base further includes tapered conductive contact pins for engagement with tapered openings in the boss and with said boss having larger diameter tapered opening serving as guide means when lamp lead-in wires are being inserted.

* * * * *